US009661966B2

(12) United States Patent
Park et al.

(10) Patent No.: US 9,661,966 B2
(45) Date of Patent: May 30, 2017

(54) VACUUM CLEANER

(71) Applicant: SAMSUNG ELECTRONICS CO., LTD., Suwon-si, Gyeonggi-do (KR)

(72) Inventors: Joung Soo Park, Jeonju-si (KR); Ki Man Kim, Gwangju (KR); Dong Jun Kim, Gwangju (KR); Hyoun Soo Kim, Gwangju (KR); Seok Bong Baek, Gwangju (KR); Suzuki Naruhiko, Gwangju (KR); Dong Hyun Lee, Changwon-si (KR); Jin Ho Lee, Gwangju (KR); Jong Gook Lim, Gwangju (KR); Kyoung Hui Jeon, Seosan-si (KR); Jun Hoo Choe, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/000,827

(22) Filed: Jan. 19, 2016

(65) Prior Publication Data

US 2016/0135654 A1 May 19, 2016

Related U.S. Application Data

(63) Continuation of application No. 14/192,161, filed on Feb. 27, 2014, now Pat. No. 9,247,854.

(30) Foreign Application Priority Data

Jun. 11, 2013 (KR) ..... 10-2013-0066695

(51) Int. Cl.

| | |
|---|---|
| ***A47L 9/10*** | (2006.01) |
| ***A47L 5/36*** | (2006.01) |
| ***A47L 9/00*** | (2006.01) |

(52) U.S. Cl.
CPC ..... *A47L 5/362* (2013.01); *A47L 9/009* (2013.01); *A47L 9/10* (2013.01)

(58) Field of Classification Search
CPC ..... A47L 5/362; A47L 9/10; A47L 9/009
See application file for complete search history.

(56) References Cited

U.S. PATENT DOCUMENTS

| | | | |
|---|---|---|---|
| 5,709,007 | A | 1/1998 | Chiang |
| 2005/0015917 | A1 | 1/2005 | Mattingly et al. |

(Continued)

FOREIGN PATENT DOCUMENTS

| | | |
|---|---|---|
| EP | 2368472 | 9/2011 |
| GB | 2469052 | 10/2010 |

(Continued)

OTHER PUBLICATIONS

U.S. Notice of Allowance dated Sep. 25, 2015 from U.S. Appl. No. 14/192,161.

(Continued)

*Primary Examiner* — David Redding
(74) *Attorney, Agent, or Firm* — Staas & Halsey LLP

(57) ABSTRACT

A vacuum cleaner includes a main body including a fan motor to generate suction force, a suction unit connected to the main body to suction foreign matter from a surface to be cleaned in a state of contacting the surface, a dust collector separatably mounted to the main body to separate and collect dust from air suctioned by the suction unit, and a wheel assembly to move the main body, wherein the wheel assembly includes frames provided at a lower part and left and right sides of the main body and wheels rotatably mounted to the frames provided at the left and right sides of the main body, each wheel having a negative camber angle.

20 Claims, 17 Drawing Sheets

(56) References Cited

U.S. PATENT DOCUMENTS

| | | | |
|---|---|---|---|
| 2005/0108849 | A1 | 5/2005 | Lam |
| 2007/0094821 | A1 | 5/2007 | Peterson |
| 2010/0242213 | A1 | 9/2010 | Sunderland |

FOREIGN PATENT DOCUMENTS

| | | |
|---|---|---|
| GB | 2487397 | 7/2012 |
| JP | 2001-314356 | 11/2001 |

OTHER PUBLICATIONS

U.S. Appl. No. 14/192,161, filed Feb. 27, 2014, Joung Soo Park.
Australian Notice of Acceptance dated Jun. 16, 2016 in corresponding Australian Patent Application No. 2014278964.
Canadian Notice of Allowance dated Oct. 12, 2016 in corresponding Canadian Patent Application No. 2,914,621.
Extended European Search Report dated Mar. 20, 2017 in corresponding European Patent Application No. 14811538.9.
Russian Notice of Allowance dated Feb. 8, 2017 in corresponding Russian Patent Application No. 2015153069/12(081758).
Russian Search Report dated Jan. 30, 2017 in corresponding Russian Patent Application No. 2015153069/12(081758).

VACUUM CLEANER

CROSS-REFERENCE TO RELATED APPLICATIONS

This application is a continuation of U.S. patent application Ser. No. 14/192,161, filed on Feb. 27, 2014, which is currently pending, and claims the benefit of Korean Patent Application No. 10-2013-0066695, filed on Jun. 11, 2013 in the Korean Intellectual Property Office, the disclosures of each of which are incorporated herein by reference.

BACKGROUND

1. Field

One or more embodiments relate to a vacuum cleaner that performs straight movement and direction change.

2. Description of the Related Art

A vacuum cleaner is a device that suctions air using suction force generated by a fan and a motor and filters foreign matter from the suctioned air to perform cleaning.

The vacuum cleaner includes a dust collector to filter foreign matter from the suctioned air using a predetermined filtering device. A porous filter unit to forcibly filter foreign matter from air when the air passes through a porous filter or a cyclone type dust collection unit to filter foreign matter from air during cyclonic flow of the air may be used as the filtering device.

The vacuum cleaner includes a main body including a dust collector to separate and collect foreign matter from air, a suction nozzle assembly to suction foreign matter, such as dust, from a floor while moving along the floor, and a connection pipe to guide the foreign matter suctioned by the suction nozzle assembly to the main body.

The suction nozzle assembly includes a suction head, a handle pipe, and an extension pipe connected between the handle pipe and the suction head. The suction head may suction foreign matter from a surface to be cleaned while contacting the surface. The handle pipe is connected to the suction head for user manipulation. The handle pipe and the suction head are connected to each other via the extension pipe. A user may perform cleaning while holding the handle pipe connected to the suction head.

The main body and the suction nozzle assembly may be connected to each other via the connection pipe. One side of the connection pipe may be connected to the suction nozzle assembly and the other side of the connection pipe may be connected to the main body. A flexible hose may be used as the connection pipe.

The main body includes an air suction device to generate suction force. The vacuum cleaner is provided at one side thereof with a dust collection container mounting unit, to which a dust collection container is mounted. The main body may be provided with a wheel assembly to move the main body.

In a conventional vacuum cleaner, traveling wheels are provided at opposite sides of the rear of the main body and a caster to change the direction of the main body is provided at the front of the bottom of the main body. In this case, although the direction of the main body is abruptly changed by a user, the traveling direction of the traveling wheels is not changed accordingly. As a result, the main body may be forcibly moved in a state in which the traveling wheels are lifted from the floor or the main body may overturn.

In a case in which the wheel assembly includes only a caster rotatable in all directions, on the other hand, the main body may shake even during straight movement of the main body with the result that the main body may collide with a wall or furniture in a room. In addition, when a carpet is cleaned, the main body may not easily travel on the carpet due to a long pile of the carpet.

SUMMARY

The foregoing described problems may be overcome and/or other aspects may be achieved by one or more embodiments of a vacuum cleaner that may be configured such that a main body may first rotate independently of a wheel assembly during change in direction of the vacuum cleaner and then the wheel assembly may rotate in a direction in which the main body is directed to change a movement direction of the main body and the center of gravity of the vacuum cleaner may be located at the rear of each wheel to possibly improve straight mobility of the main body due to the wheel assembly.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a vacuum cleaner may include a main body that may include a fan motor to generate suction force, a suction unit connected to the main body to suction foreign matter from a surface to be cleaned when contacting the surface, a dust collector separatably mounted to the main body to possibly separate and collect dust from air suctioned by the suction unit, and a wheel assembly to move the main body, wherein the wheel assembly may include frames provided at a lower part and left and right sides of the main body and wheels rotatably mounted to the frames provided at the left and right sides of the main body, each wheel possibly having a negative camber angle.

Each wheel may be toed in such that the front of each wheel is directed inwardly of the main body and the rear of each wheel is directed outwardly.

The center of gravity of the main body may be located behind the center of rotation of each wheel.

The main body may be provided at the bottom thereof with a caster rotatable in all directions.

The caster may include a steering shaft mounted at the bottom of the main body, a caster frame rotatable about the steering shaft in all directions, a rotary shaft mounted to the caster frame, and a caster wheel rotatable about the rotary shaft to travel on a floor.

The rotary shaft may be spaced from a straight line extending from the steering shaft by a predetermined distance.

The main body may be rotatable independently of the wheel assembly such that the main body rotates to change a movement direction thereof and the main body is moved in the changed direction by the wheel assembly.

The frame provided at the lower part of the main body may be provided with a ring-shaped first rotation guide in a protruding state.

The main body may be provided at the bottom thereof with a receiving unit to possibly receive the first rotation guide.

The receiving unit may be provided at the inside thereof with a second rotation guide in a protruding state, the second rotation guide possibly functioning as a rotary shaft of the main body.

The frame provided at the lower part of the main body may be provided with a guide-receiving groove, into which the second rotation guide may be inserted.

The guide-receiving groove may be formed at the first rotation guide and the second rotation guide may be rotatably inserted into the guide-receiving groove.

The frame provided at the lower part of the main body may be provided with an elastic member.

The main body may be provided at the bottom thereof with a pressing unit to press the elastic member.

The pressing unit may press the elastic member when the main body rotates to possibly change the movement direction thereof.

The wheel assembly may be rotated in a direction in which the main body is directed by elastic force of the elastic member.

The frame provided at the lower part of the main body may be provided with an elastic member mounting unit to receive the elastic member.

The elastic member mounting unit may be provided at the side thereof with a hole, through which the pressing unit may press the elastic member.

The pressing unit may be provided in a receiving unit that may be formed at the bottom of the main body.

The inside of the receiving unit may interfere with the elastic member mounting unit or a stopper that may be provided at the frame that may be provided at the lower part of the main body to possibly restrict a rotational angle of the main body.

In accordance with one or more embodiments, a vacuum cleaner may include a main body that may include a fan motor to generate suction force and a wheel assembly, to which the main body may be rotatably mounted, to move the main body, wherein the wheel assembly may include frames provided at a lower part and left and right sides of the main body and wheels rotatably mounted to the frames that may be provided at the left and right sides of the main body, each wheel possibly having a negative camber angle.

The main body may be rotatable independently of the wheel assembly such that the main body may rotate to change a movement direction thereof and the main body may be moved in the changed direction by the wheel assembly.

Each wheel may be toed in such that the front of each wheel may be directed inwardly of the main body and the rear of each wheel may be directed outwardly.

The center of gravity of the main body may be located behind the center of rotation of each wheel.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
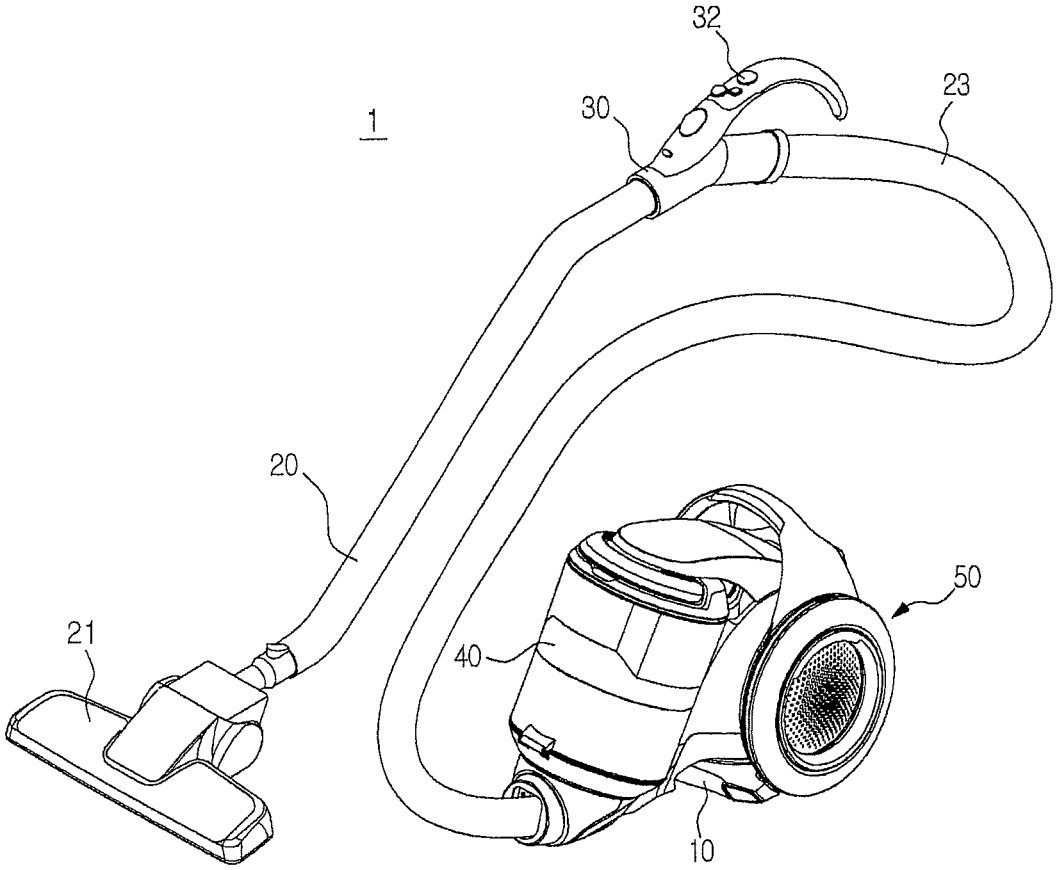
FIG. 1 is a view showing a vacuum cleaner according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Figure 2:
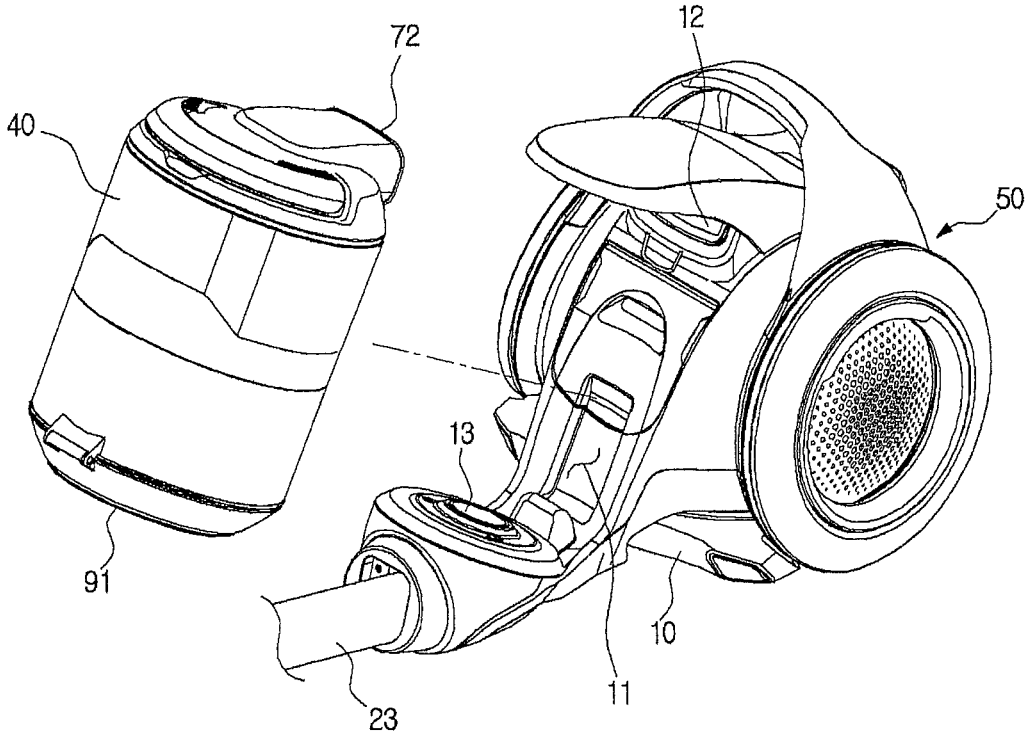
FIG. 2 is a view showing a state in which a dust collector is separated from a main body according to one or more embodiments.

FIG. 1 is a view showing a vacuum cleaner according to one or more embodiments and FIG. 2 is a view showing a state in which a dust collector is separated from a main body according to one or more embodiments.

Referring to FIGS. 1 and 2, a vacuum cleaner 1 according to one or more embodiments may include a main body 10, a dust collector 40, a suction unit 21, and a wheel assembly 50. The dust collector 40 and the wheel assembly 50 may be mounted to the main body 10. The suction unit 21 may contact a surface to be cleaned to suction foreign matter from the surface. The vacuum cleaner 1 according to one or more embodiments may be a canister type vacuum cleaner.

The main body 10 may include a fan motor (not shown) to generate suction force. The suction unit 21 may suction air from the surface, including dust contained in the air, using suction force generated by the main body 10. The suction unit 21 may be formed in a wide shape such that the suction unit 21 may tightly contact the surface.

Between the main body 10 and the suction unit 21 may be provided an extension pipe 20, a handle pipe 30, and a flexible hose 23. The extension pipe 20 may be made, for example, of a resin or metal material, but is not limited thereto. The extension pipe 20 may be connected between the suction unit 21 and the handle pipe 30.

The handle pipe 30 may be connected between the extension pipe 20 and the flexible hose 23. A handle 31 and a manipulator 32 may be provided at the handle pipe 30. A user may perform cleaning while holding the handle 31. In addition, the user may manipulate buttons of the manipulator 32 to turn the cleaner on/off or adjust a suction degree.

The flexible hose 23 may be connected between the handle pipe 30 and the main body 10. The flexible hose 23 may be made of a flexible material such that the handle pipe 30 may move freely.

The suction unit 21, the extension pipe 20, the handle pipe 30, and the flexible hose 23 may communicate with each other. Air suctioned from the suction unit 21 may be introduced into the main body 10 through the extension pipe 20, the handle pipe 30, and the flexible hose 23.

The main body 10 may be provided with a suction port 13 to guide the suctioned air to the dust collector 40 and a discharge port 12 to discharge air purified by the dust collector 40. The discharge port 12 may communicate with a fan motor compartment (not shown) in which the fan motor (not shown) may be mounted.

The main body 10 may be provided with a mounting unit 11, to which the dust collector 40 may be mounted. The dust collector 40 may be separatably mounted to the mounting unit 11. The dust collector 40 may separate dust from the air suctioned through the suction unit 21 and may discharge purified air through the discharge port 12.

The dust collector 40 may include an inlet 91, through which air containing dust may be introduced, and an outlet 72, through which purified air may be discharged. When the dust collector 40 is mounted to the main body 10, the inlet 91 may communicate with the suction port 13 of the main body 10 and the outlet 72 may communicate with the discharge port 12 of the main body 10.

The dust collector 40 may separate dust from air using centrifugal force generated by a swirling air current. When dust accumulates in the dust collector to some extent, the user may separate the dust collector 40 from the main body 10 and remove the dust from the dust collector 40.

The main body 10 may be mounted to the wheel assembly 50. The main body 10 may be moved on a floor by the wheel assembly 50. The wheel assembly 50 may include a frame 51 and wheels 52. The frame 51 may be connected to the main body 10 and the wheels 52 may be mounted to the frame 51. The wheels 52 may be located at opposite sides of the main body 10.

The main body 10 may be provided at the bottom thereof with a caster 60 and an auxiliary wheel 70. The caster 60 may be located at the front of the main body 10 such that the caster 60 rotates in all directions to smoothly rotate the main body 10. The main body 10 may be supported on the floor at three points by the caster 60 and the wheels 52 that may be provided at the left and right sides of the main body 10. The caster 60 may be located at the front of the bottom of the main body 10, at which the flexible hose 23 may be connected to the main body 10. When a direction of the flexible hose 23 is changed by user manipulation, the front of the main body 10 may rotate in a direction in which the flexible hose 23 is directed.

The auxiliary wheel 70 may be provided at the rear of the bottom of the main body 10 such that the auxiliary wheel 70 may rotate about a rotary shaft (not shown). The auxiliary wheel 70 may assist the main body 10 in movement by the wheel assembly 50.

Hereinafter, structures of the main body and the wheel assembly according to one or more embodiments will be described in detail with reference to the accompanying drawings.

Figure 3:
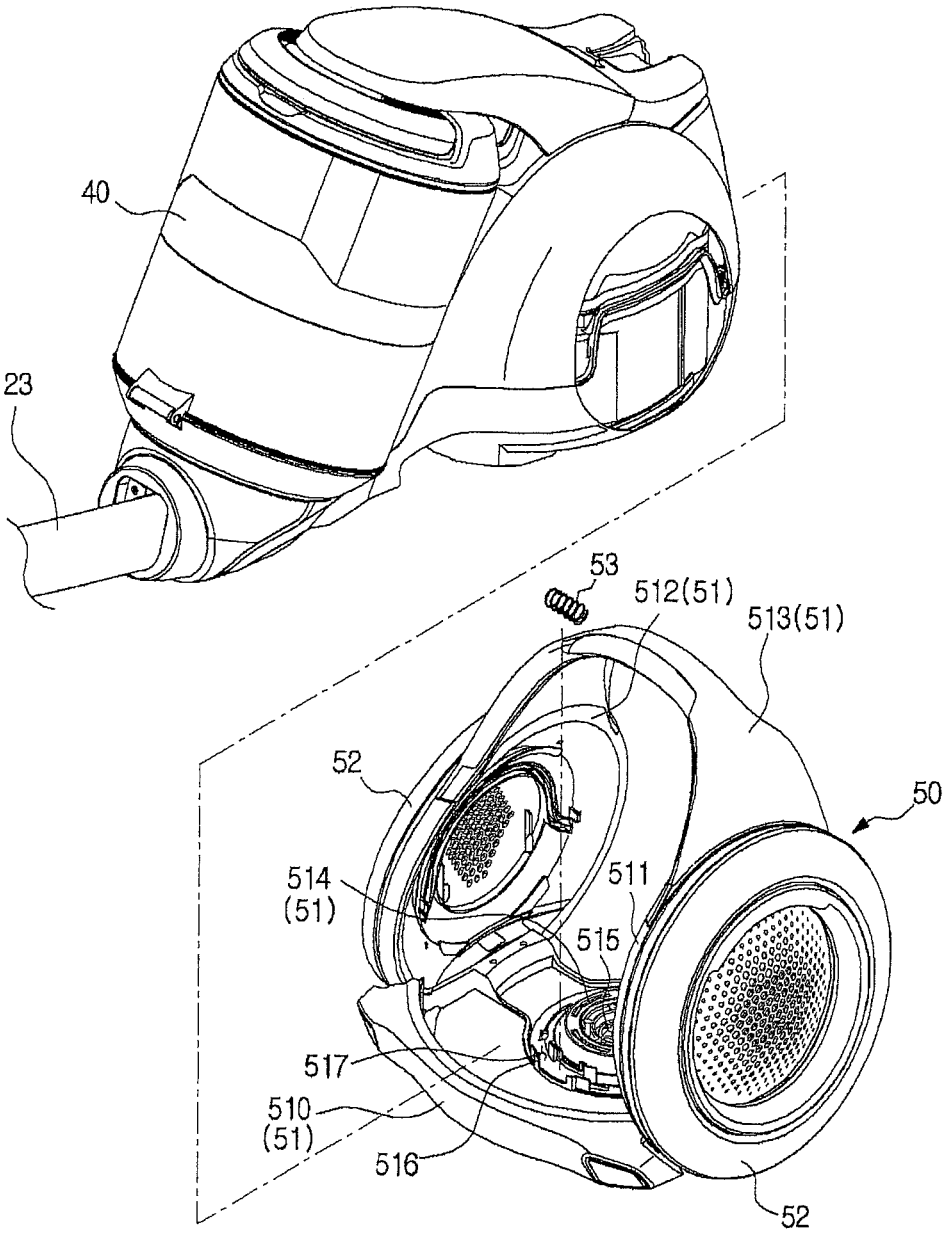
FIG. 3 is a view showing a state in which a wheel assembly is separated from the main body according to one or more embodiments.
Figure 4:
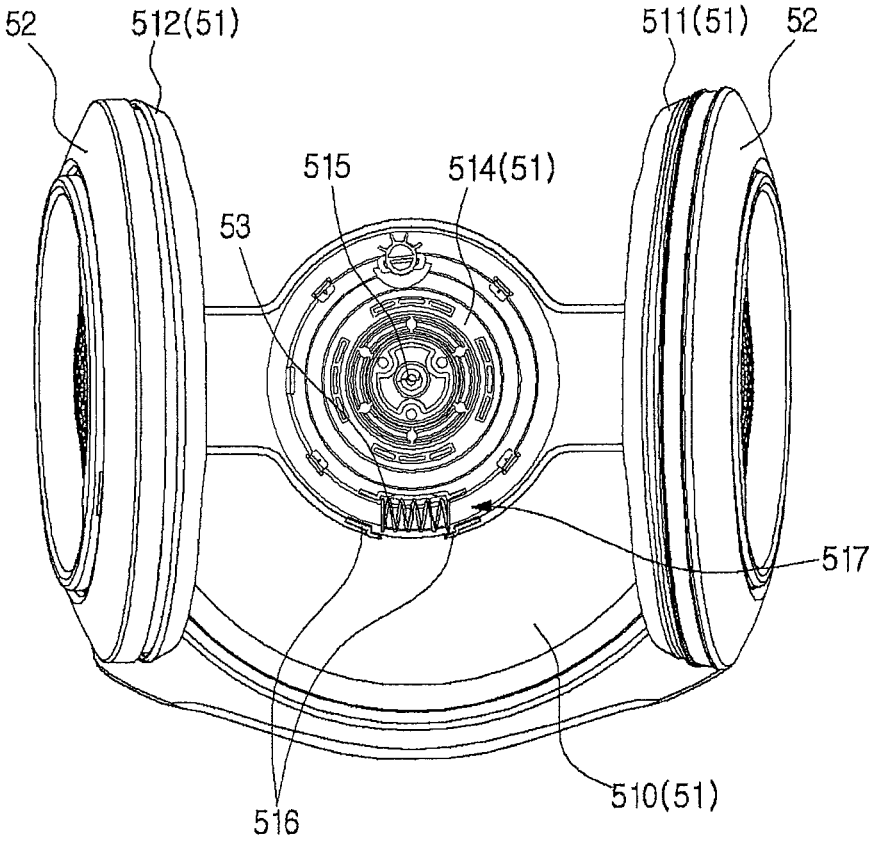
FIG. 4 is a view showing a wheel assembly according to one or more embodiments.
Figure 5:
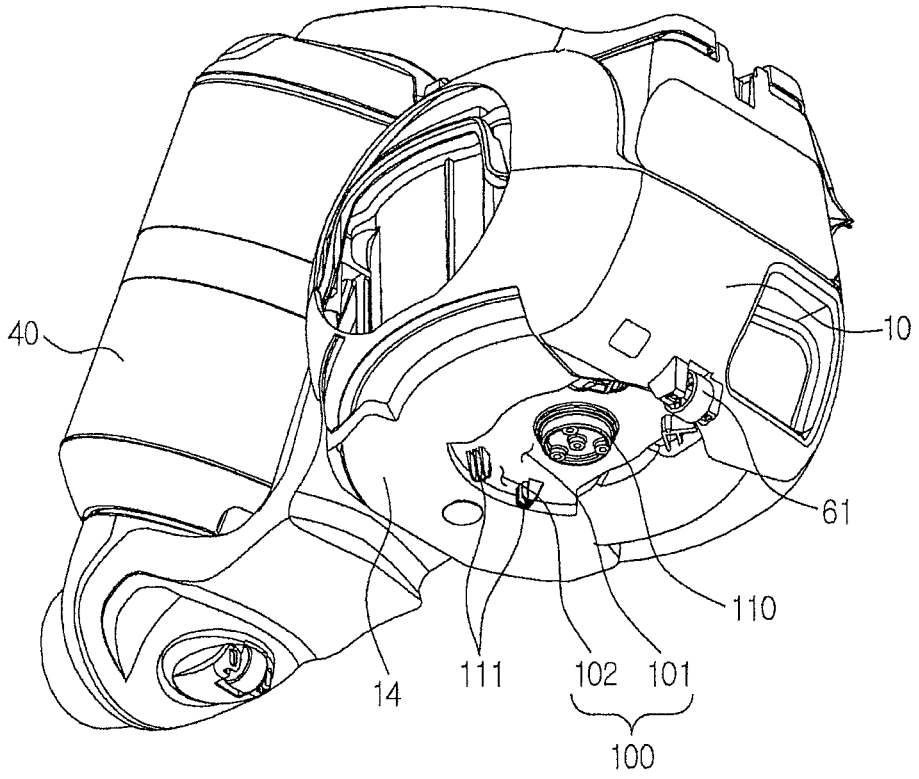
FIG. 5 is a view showing a lower part of the main body according to one or more embodiments.

FIG. 3 is a view showing a state in which the wheel assembly is separated from the main body according to one or more embodiments, FIG. 4 is a view showing the wheel assembly according to one or more embodiments, and FIG. 5 is a view showing a lower part of the main body according to one or more embodiments.

Referring to FIGS. 3 to 5, the main body 10 according to one or more embodiments may be rotatably mounted to the wheel assembly 50. The main body 10 may be moved by the wheel assembly 50. When the direction of the flexible hose 23 is changed by user manipulation during cleaning, the main body 10 may rotate in the changed direction of the flexible hose 23 independently of the wheel assembly 50.

The wheel assembly 50 may include a frame 51 and wheels 52 rotatably mounted to the frame 51. The wheels 52 may be provided at left and right sides of the main body 10 in a movement direction of the main body 10. The wheels 52 may move the main body 10 in a movement direction of the flexible hose 23 connected to the main body 10.

The frame 51 may include a first frame 511 and a second frame 512, to which the wheels 52 provided at the left and right sides of the main body 10 may be mounted, and a third frame 510 that may be connected between the first frame 511 and second frame 512. The third frame 510 may be located at a lower part of a base 14 that may be provided at the bottom of the main body 10. The frame 51 may further include a fourth frame 513 located at an upper part of the main body 10. The fourth frame 513 may be connected between the first frame 511 and second frame 512.

The main body 10 may rotate relative to the frame 51. The base 14 of the main body 10 and the third frame 510 may be rotatably coupled to each other via a fastening member.

A first rotation guide 514 to guide rotation of the main body 10 may be formed at the third frame 510 in a protruding state. The first rotation guide 514 may be formed in a ring shape. The first rotation guide 514 may be inserted into a receiving unit 100, which will hereinafter be described, formed at the base.

The first rotation guide 514 may be provided with a guide-receiving groove 515. A second rotation guide 514, which will hereinafter be described, formed at the base 14 may be inserted into the guide-receiving groove 515.

An elastic member 53 may be provided at one side of the third frame 510. The third frame 510 may be provided with an elastic member mounting unit 516. The elastic member 53 may be received in the elastic member mounting unit 516. The elastic member mounting unit 516 may protrude from the third frame 510. The elastic member mounting unit 516 may be located outside the first rotation guide 514.

The third frame 510 may be provided with a stopper. The elastic member mounting unit 516 protruding from the third frame 510 may function as the stopper. Alternatively, the stopper may be formed at the third frame 510 separately from the elastic member mounting unit 516 in a protruding state. The stopper may be provided at the other side of the third frame 510 separately from the elastic member mounting unit 516.

In this case, the stopper may be provided opposite to the elastic member mounting unit 516 with respect to the center of rotation of the first rotation guide 514. The distance from the center of rotation of the first rotation guide 514 to the elastic member mounting unit 516 may be equal to that from the first rotation guide 514 to the stopper.

Holes 517 may be formed at opposite sides of the elastic member mounting unit 516. Pressing units 111, which will hereinafter be described, may be formed at the base 14. The pressing units 111 may press the elastic member 53 received in the elastic member mounting unit 516 through the holes 517.

A receiving unit 100 may formed at the base 14 provided at the bottom of the main body 10. The first rotation guide 514 of the third frame 510 may be rotatably received in the receiving unit 100. The elastic member mounting unit 516 may be received in the receiving unit 100.

The receiving unit 100 may include a first receiving unit 101 and a second receiving unit 102. The first receiving unit 101 may be formed in the shape of a circle R1 corresponding to the outer diameter of the first rotation guide 514. The second receiving unit 102 may be located outside the first receiving unit 101. Specifically, the second receiving unit 102 may be located at the front or the rear of the first receiving unit 101 such that the second receiving unit 102 may be connected to the first receiving unit 101. The receiving unit 100 may extend backward and forward with respect to the movement direction of the main body 10.

The second receiving unit 102 may be formed in the shape of a portion of a circle R2 corresponding to a movement route of the outside of the elastic member mounting unit 516 or the outside of the stopper during rotation of the base 14. That is, the inside of the receiving unit 100 forming the second receiving unit 102 may be provided to correspond to a portion of the circle R2 corresponding to the movement route of the outside of the elastic member mounting unit 516 or the outside of the stopper during rotation of the base 14, i.e. an arc of a sector having a central angle θ1. The shape of the second receiving unit that may be formed at the pressing units 111 may correspond to that of the second receiving unit into which the stopper provided at the third frame 510 may be inserted.

Since the second receiving unit 102 may not be formed in the shape of the entirety of the circle R2 corresponding to the movement route of the outside of the elastic member mounting unit 516 or the outside of the stopper but may be formed in the shape of a portion of the circle R2, the side of the stopper or the elastic member mounting unit 516 may interfere with the inside of the receiving unit 100 forming the second receiving unit 102 with the result that a rotational angle of the main body may be restricted.

The second rotation guide 110 may be formed at the base 14 provided at the bottom of the main body 10 in a protruding state. The second rotation guide 110 may be a rotary shaft, about which the main body 10 may rotate. When the main body is mounted to the wheel assembly 50, the second rotation guide 110 may be inserted into the guide-receiving groove 515 formed at the third frame 510. The second rotation guide 110 may rotate in a state in which the second rotation guide 110 is inserted into the guide-receiving groove 515.

Hereinafter, an operation of changing a movement direction of the main body 10, based on the structures of the wheel assembly 50 and the base 14, will be described.

Figure 6A:
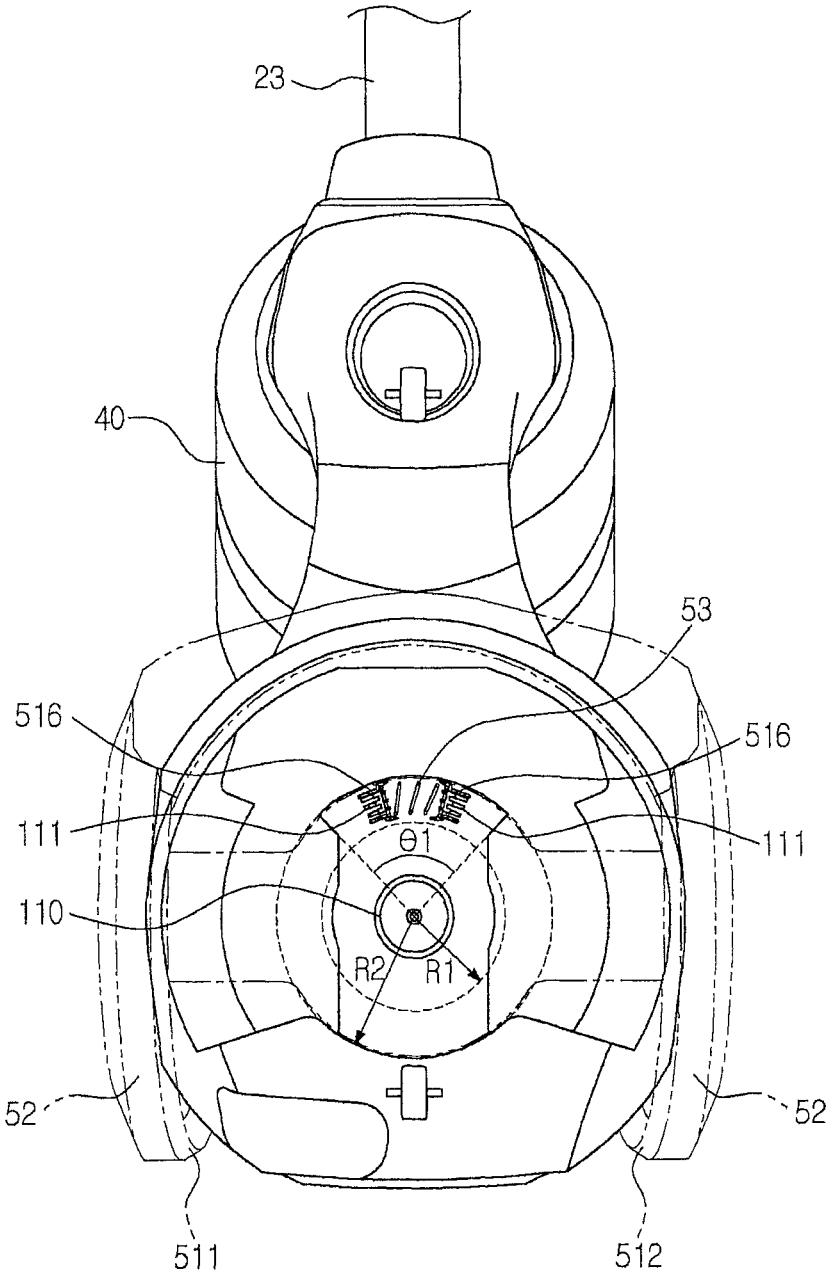
FIGS. 6A to 6C are views showing the main body according to one or more embodiments before and after rotation when viewed from below.
Figure 6B:
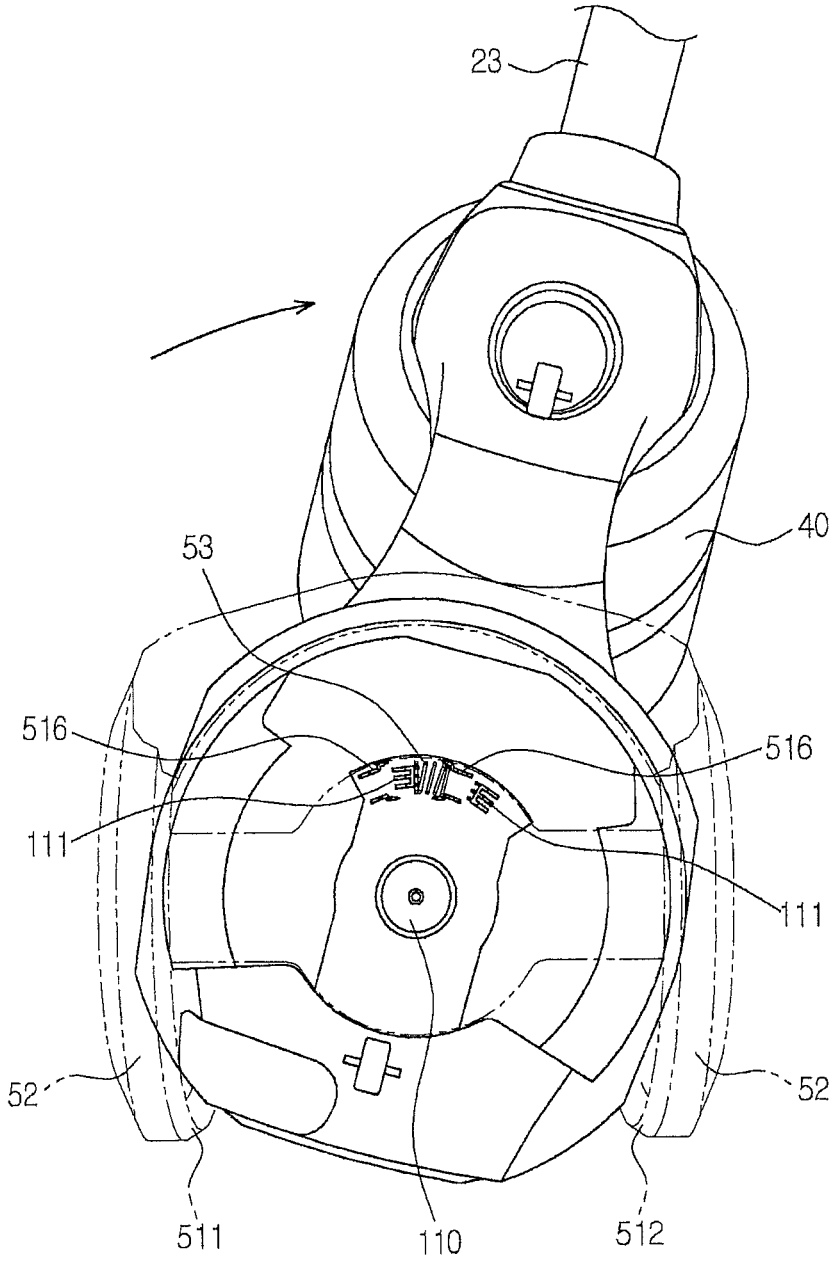
Figure 6C:
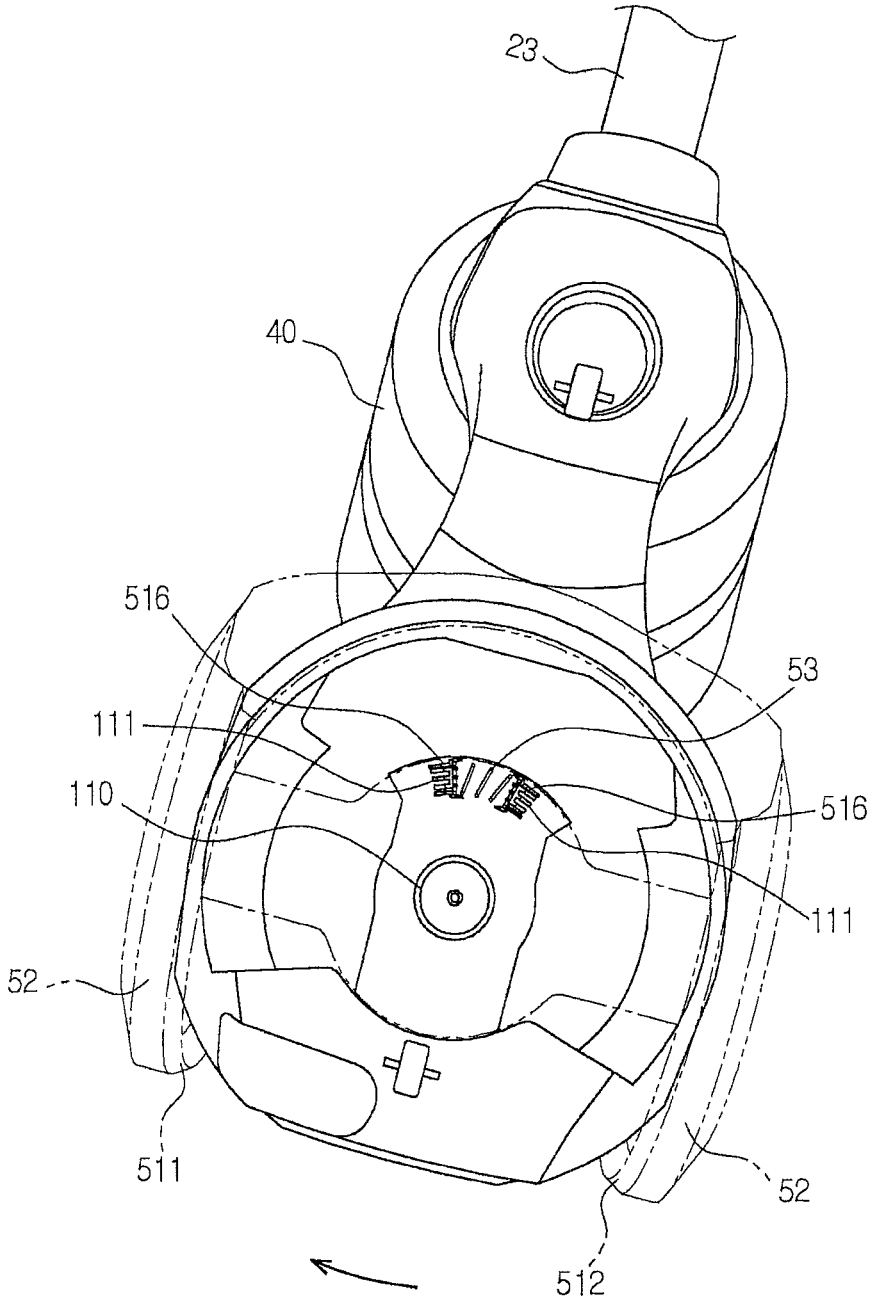
Figure 7A:
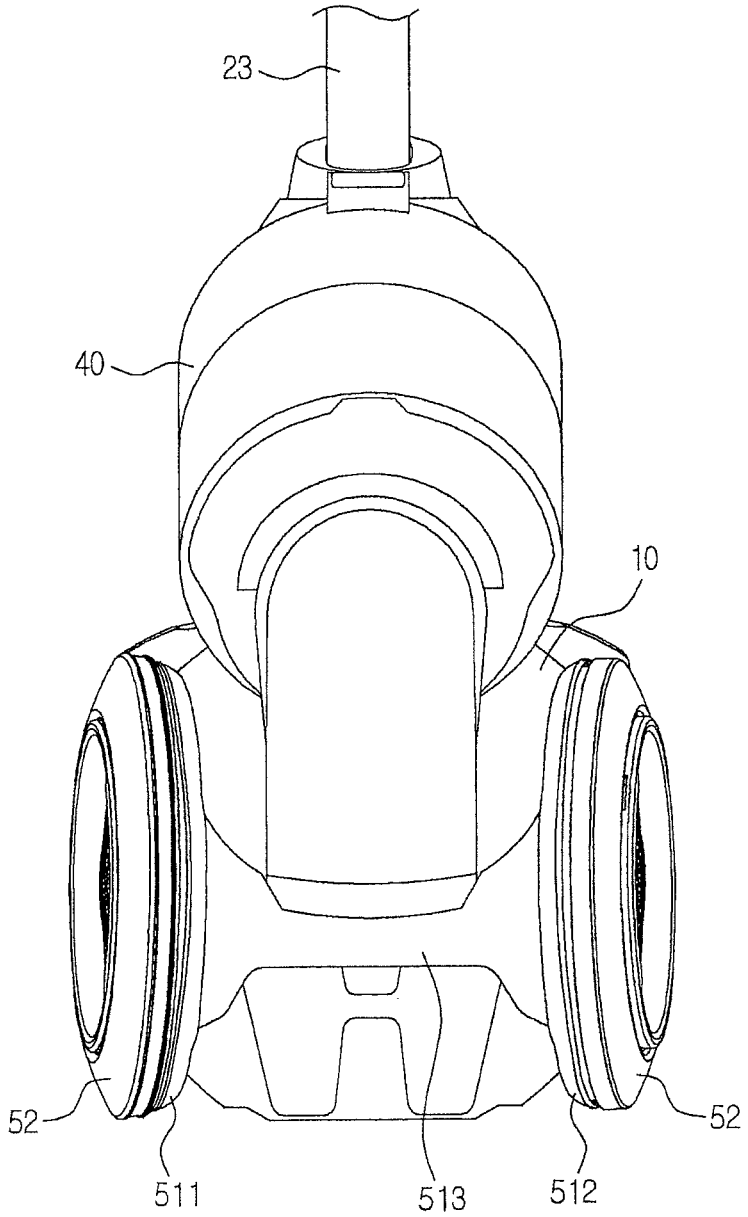
FIGS. 7A to 7C are views showing the main body according to one or more embodiments before and after rotation when viewed from above.
Figure 7B:
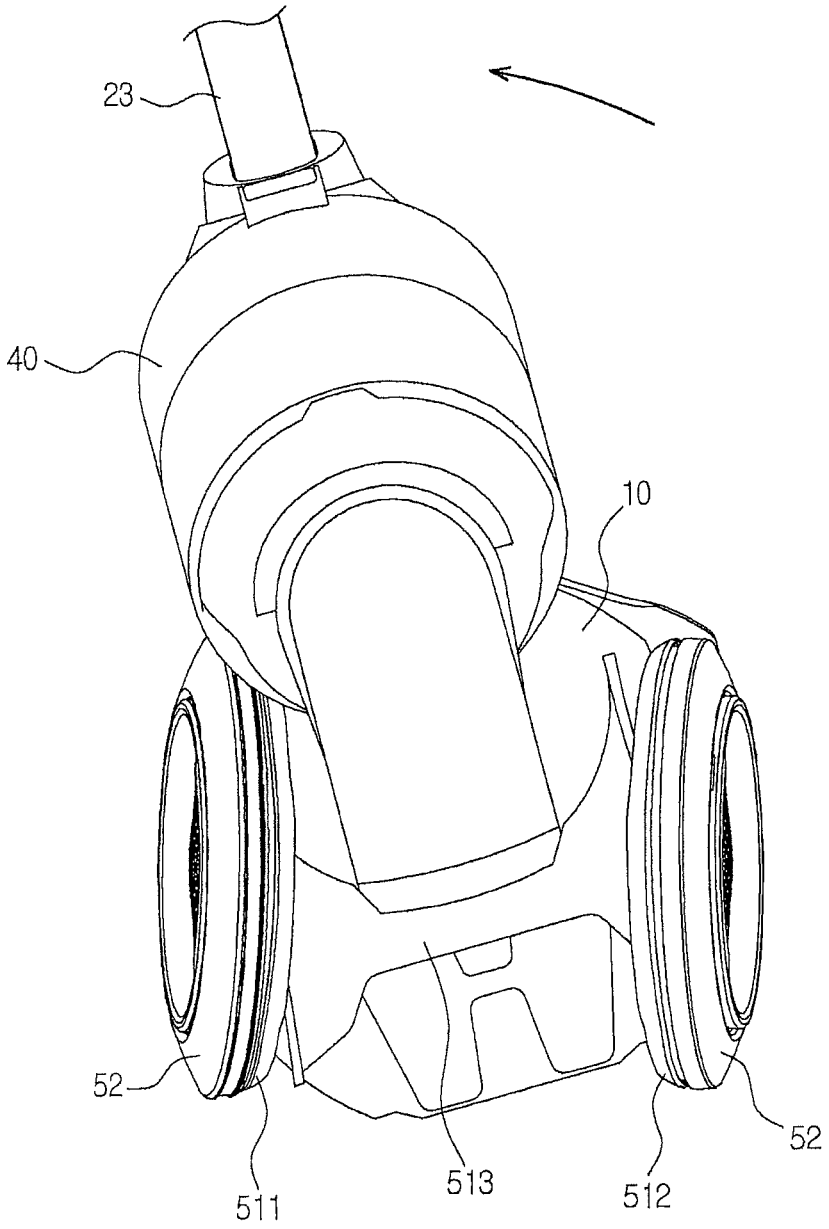
Figure 7C:
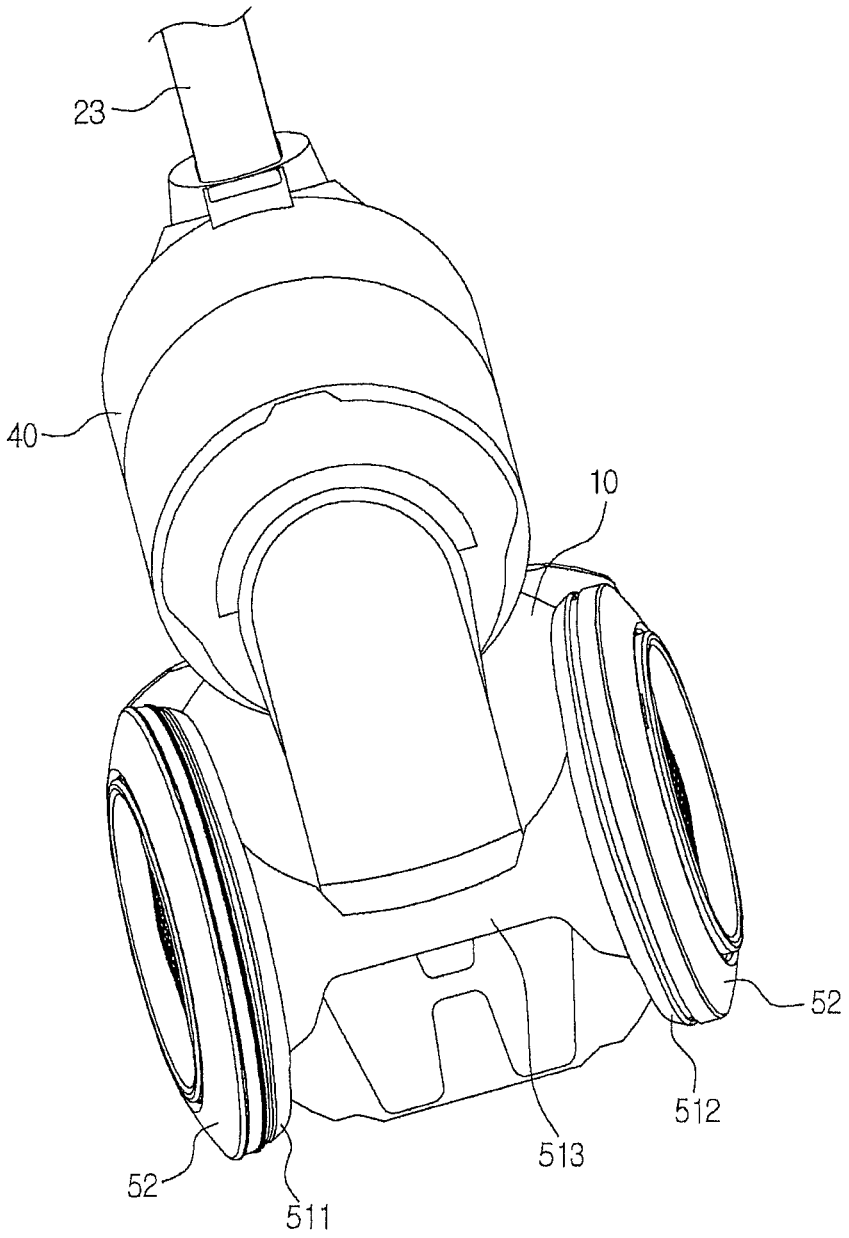
Figure 8:
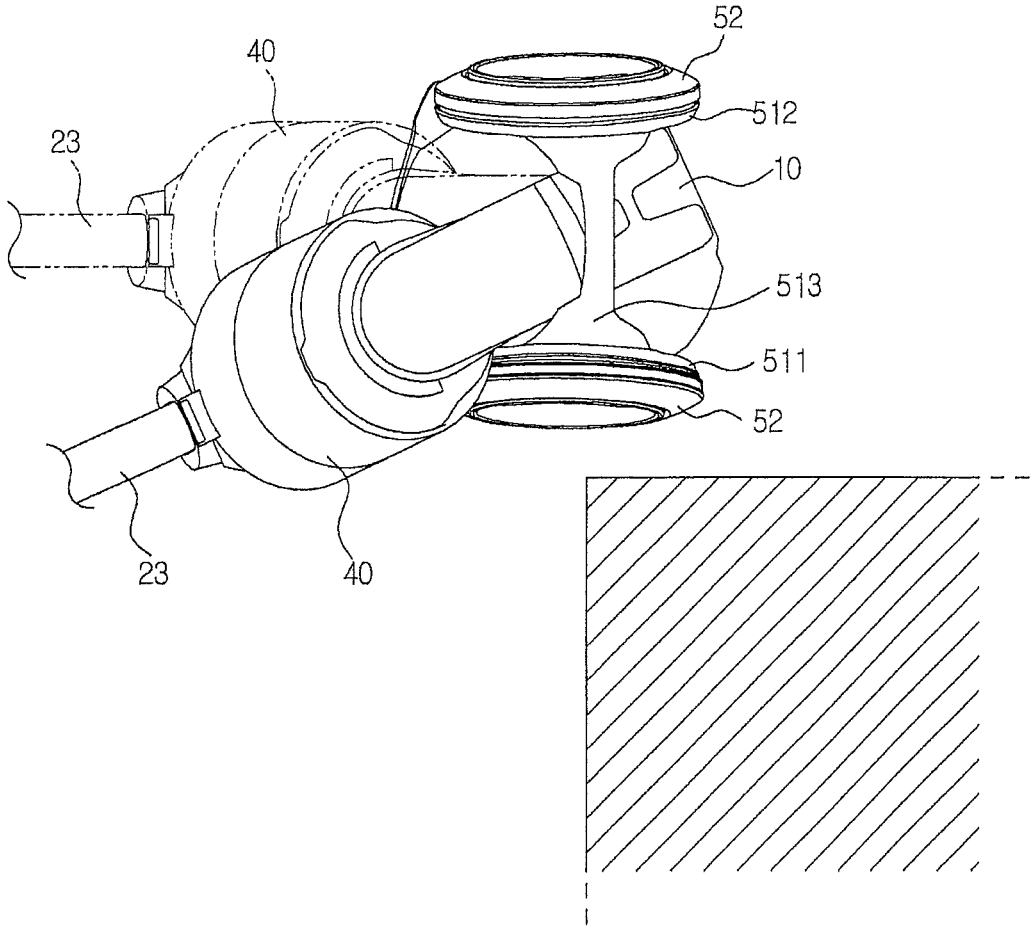
FIG. 8 is a view showing that the main body according to one or more embodiments turns at a corner and moves.

FIGS. 6A to 6C are views showing the main body according to one or more embodiments before and after rotation when viewed from below, FIGS. 7A to 7C are views showing the main body according to one or more embodiments before and after rotation when viewed from above, and FIG. 8 is a view showing that the main body according to one or more embodiments turns at a corner and moves.

Referring to FIGS. 6A to 8, when a movement direction of the main body 10 according to one or more embodiments is changed by the flexible hose 23, etc., the main body 10 may first rotate independently of the wheel assembly as shown in FIG. 7B. After rotation of the main body 10, the wheel assembly 50 may rotate in a direction in which the main body 10 is directed due to the elastic member 53.

As shown in FIGS. 6A and 7A, the main body 10 may move in a state in which the main body 10 is located in a forward direction. As shown in FIGS. 6A and 7A, the wheel assembly 50 may be located in the same direction as the main body 10.

When the main body 10 turns at a corner or the movement direction of the main body 10 is changed by the flexible hose 23, etc. as shown in FIG. 8, the main body 10 may first rotate in a state in which the direction of the wheel assembly 50 is not changed as shown in FIGS. 6B and 7B. At this time, the pressing units 111 that may be provided at the base 14 of the main body 10 may press the elastic member 53 that may be received in the elastic member mounting unit 516 through the holes 517 that may be formed at the elastic member mounting unit 516 of the third frame 510.

When force is applied to the main body 10 in the changed movement direction of the main body 10 in a state in which the main body 10 has rotated, elastic force of the elastic member 53 may be applied to the pressing units 111 such that the pressing units 111 may return to positions before movement. As shown in FIGS. 6C and 7C, the wheel assembly 50 may naturally rotate in the direction in which the main body 10 is directed due to the elastic force that may be applied to the pressing units 111. As a result, both the main body 10 and the wheel assembly 50 may rotate and thus the movement directions of the main body 10 and the wheel assembly 50 may be changed. In a state in which the main body 10 and the wheel assembly 50 are directed in the same direction, therefore, the main body 10 may move in the movement direction after rotation.

As described above, the main body 10 may rotate independently of the wheel assembly 50 and, after rotation of the main body 10, the wheel assembly 50 may rotate in the direction in which the main body 10 is directed due to the elastic force of the elastic member 53. Consequently, the direction of the main body 10 may be changed. When the main body 10 turns at a corner as shown in FIG. 8, the main body 10 may be prevented from being pulled or overturning and the direction of the main body 10 may be changed. Consequently, straight movement of the main body 10 may be achieved by the wheel assembly 50 while rotatability of the main body 10 may be improved, thereby possibly improving user convenience and satisfaction in use.

Hereinafter, a structure to improve straight mobility of the main body 10 due to the wheel assembly according to one or more embodiments will be described.

Figure 9:
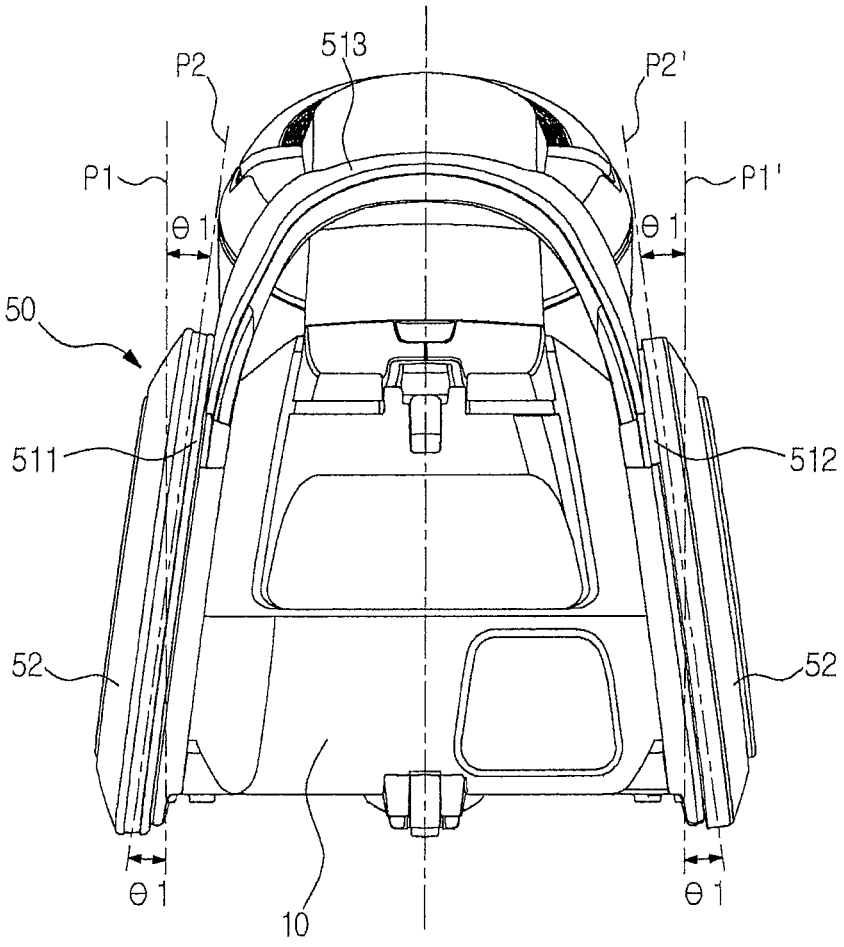
FIGS. 9 and 10 are views showing a camber structure of the wheel assembly according to one or more embodiments.
Figure 10:
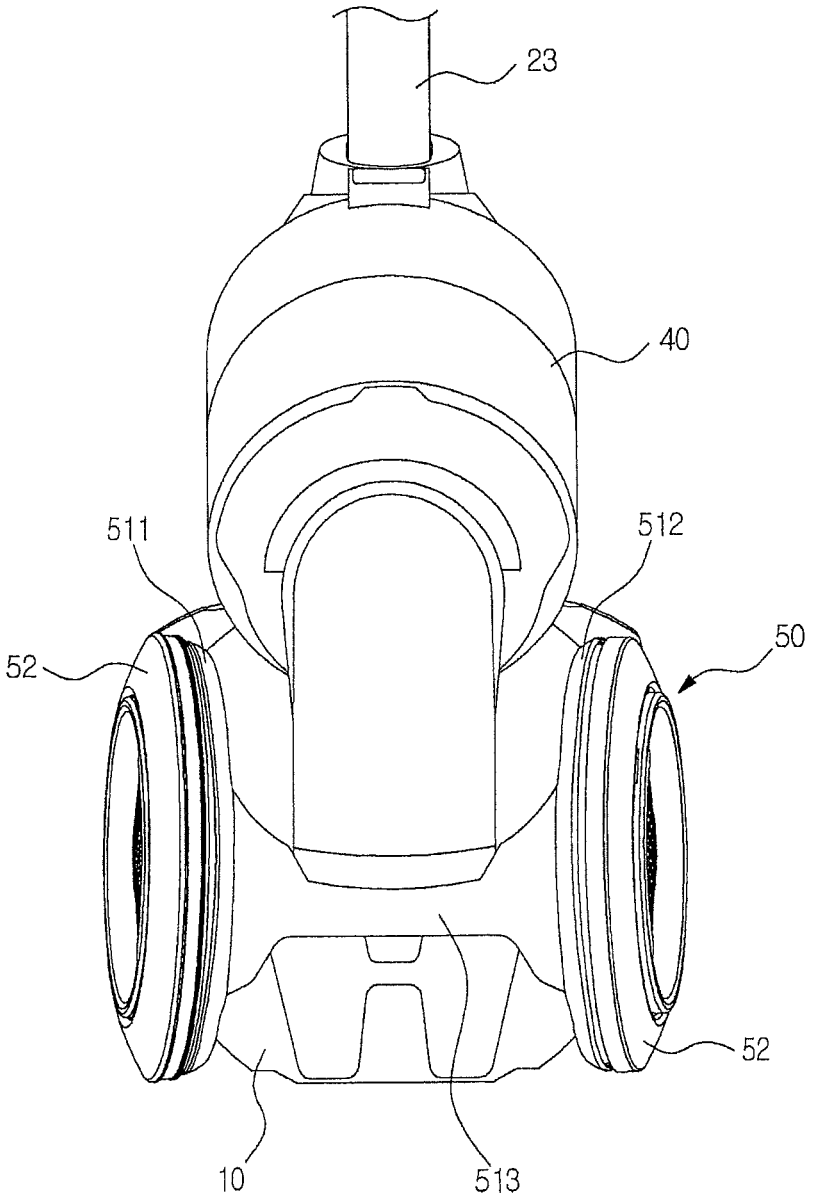

FIGS. 9 and 10 are views showing a camber structure of the wheel assembly according to one or more embodiments.

Referring to FIGS. 9 and 10, the wheel assembly 50 according to one or more embodiments may have a camber angle. Specifically, each of the wheels 52 located at the opposite sides of the main body 10 may have a camber angle.

The camber angle is an angle defined between a straight line P1 or P1' extending perpendicular from a floor on which the main body 10 is placed and a center line P2 or P2' of each wheel 52 when the main body 10 is viewed from front or rear.

The distance between the first frame 511 and the second frame 512 located at the opposite sides of the main body 10 at the upper part of the main body 10 may be greater than that at the lower part of the main body 10. When the main body 10 is viewed from front or rear, therefore, the first frame 511 and the second frame 512 located at the lower part of the main body 10 may be directed outwardly of the main body 10. The upper parts of the wheels 52 mounted to the first frame 511 and the second frame 512 may be directed inwardly of the main body 10 and the lower parts of the wheels 52 may be directed outwardly of the main body 10.

In a case in which the upper part of each wheel 52 is directed inwardly of the main body 10 as described above, each wheel 52 may have a negative camber angle. In a case in which the upper part of each wheel 52 is directed outwardly of the main body 10, on the other hand, each wheel 52 may have a positive camber angle. Each wheel 52 according to one or more embodiments may have a negative camber angle.

The camber angle may be 10 degrees or less. The camber angle may be changed depending upon load.

In a case in which each wheel 52 has a negative camber angle, the distance between the first frame 511 and the second frame 512 at the lower part of the main body 10 is greater than that at the upper part of the main body 10. Consequently, the main body 10 may be stably placed on a floor due to the wheels 52. The main body 10 may perform straight movement in a state in which the main body 10 is stably placed on the floor.

Figure 11:
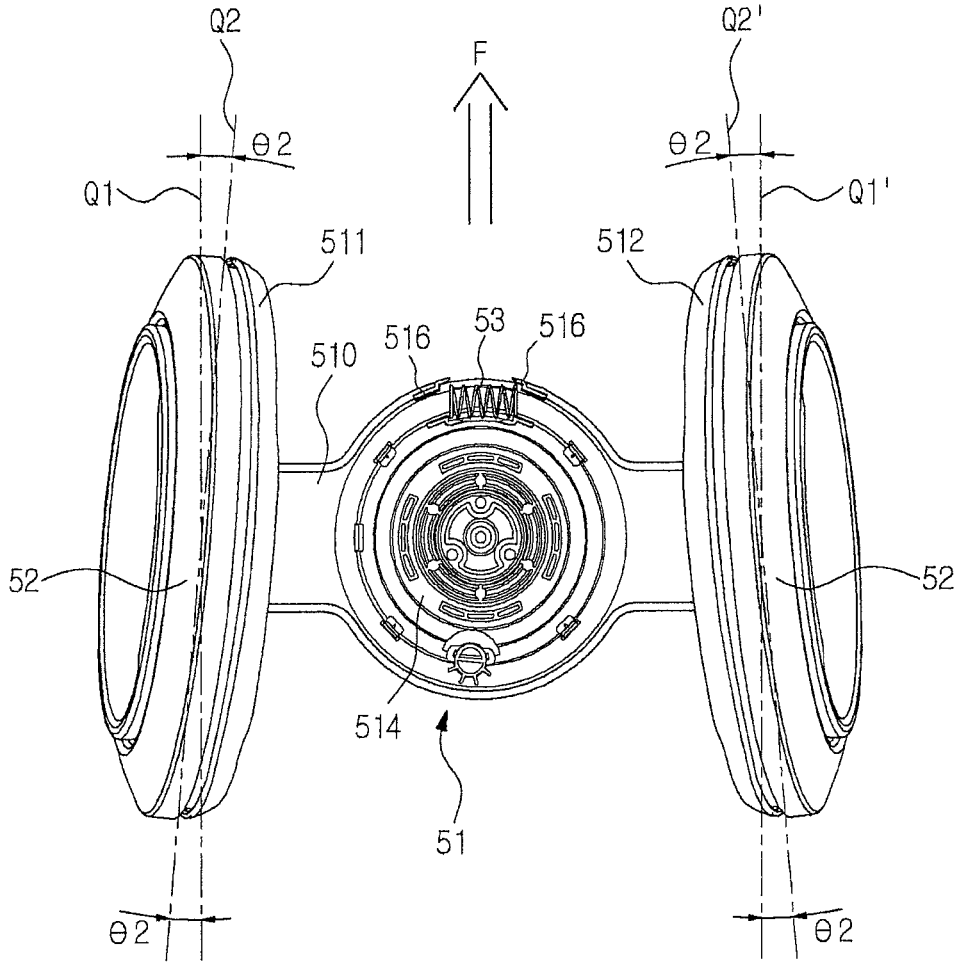
FIG. 11 is a view showing a toe-in structure of the wheel assembly according to one or more embodiments.

FIG. 11 is a view showing a toe-in structure of the wheel assembly according to one or more embodiments.

Referring to FIG. 11, the front of the wheel assembly 50 according to one or more embodiments may be directed inwardly of the main body 10 and the rear of the wheel assembly 50 may be directed outwardly of the main body 10.

When the main body 10 is viewed from above, the distance between the first frame 511 and the second frame 512 of the wheel assembly 50 at the front of the main body 10 may be less than that at the rear of the main body 10. Consequently, the front of each of the wheels 52 provided at the first frame 511 and the second frame 512 may be directed inwardly of the main body 10 and the rear of each of the wheels 52 may be directed outwardly of the main body 10.

A state in which the front of each wheel 52 is directed inwardly and the rear of each wheel 52 is directed outwardly as described above may be referred to as toe-in. On the other hand, a state in which the front of each wheel 52 is directed outwardly of the main body 10 and the rear of each wheel 52 is directed inwardly of the main body 10 may be referred to as toe-out.

Each wheel 52 according to one or more embodiments may be toed in. A predetermined angle θ2 may be defined between a straight line Q1 or Q1' parallel to a floor and perpendicular to the third frame 510 a center line Q2 or Q2' of each wheel 52.

As the wheels 52 are toed in, the wheels 52 may tend to move forwardly of the main body 10. As a result, straight mobility of the main body 10 due to the wheels 52 may be further improved.

Figure 12:
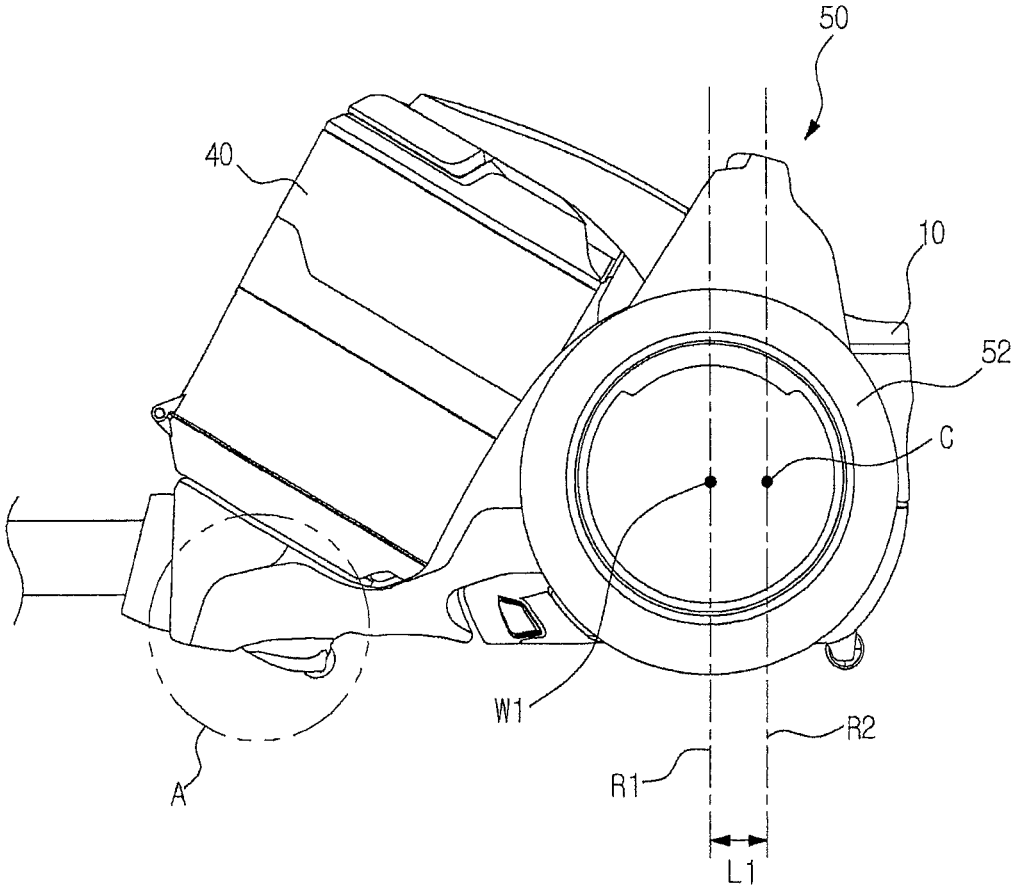
FIG. 12 is a view showing the center of gravity of the main body and the center of rotation of a wheel according to one or more embodiments.

FIG. 12 is a view showing the center of gravity of the main body and the center of rotation of each wheel according to one or more embodiments.

Referring to FIG. 12, the center of gravity C of the main body 10 according to one or more embodiments may be located behind the center of rotation W1 of each wheel 52. A straight line R1 passing through the center of rotation W1 of each wheel 52 and perpendicular to a floor may be located before a straight line R2 passing through the center of gravity C of the main body 10 and perpendicular to the floor by a predetermined distance L1.

As the center of gravity C of the main body 10 is located behind the center of rotation W1 of each wheel 52 as described above, the wheels 52 may tend to move forwardly of the main body 10 due to weight of the main body 10. As a result, straight mobility of the main body 10 due to the wheels 52 may be improved.

In addition, the wheel 52 mounted to the first frame 511 and the wheel 52 mounted to the second frame 512 may be connected to a rotary shaft (not shown). A steering shaft (not shown) may be connected to the rotary shaft (not shown) in a state in which the steering shaft (not shown) is perpendicular to the rotary shaft (not shown). The upper side of the steering shaft (not shown) may tilt rearward such that a predetermined angle is defined between the steering shaft (not shown) and a straight line extending perpendicularly from the floor. An angle defined between a straight line passing through each wheel 52 and perpendicular to the floor and the steering shaft (not shown) may be referred to as a caster angle. The provision of the caster angle may further improve straight mobility of the main body 10 due to the wheels 52.

Figure 13:
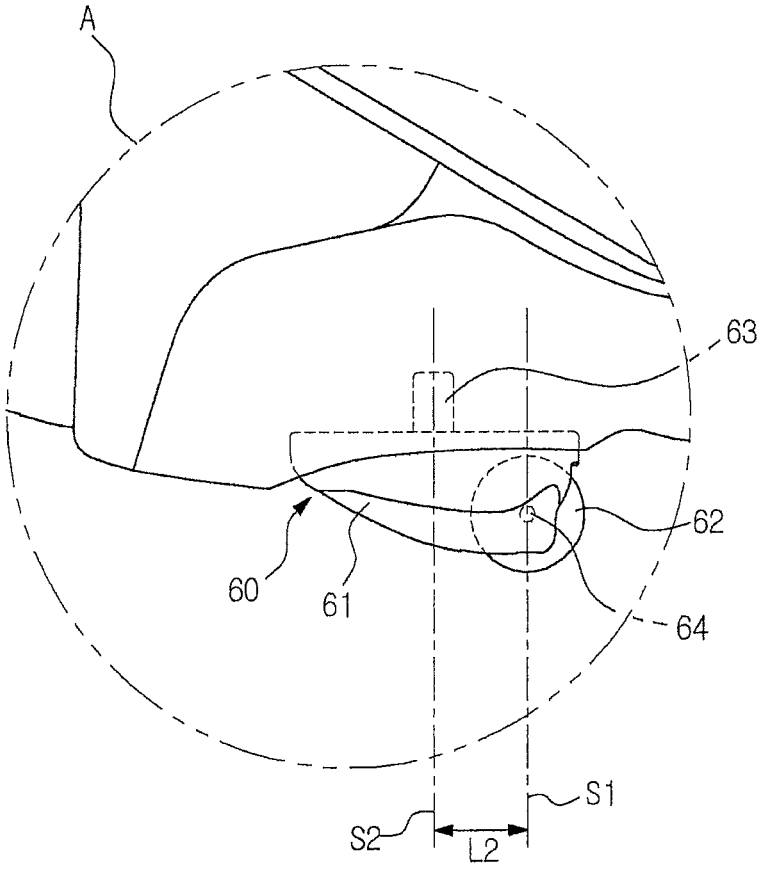
FIG. 13 is a view showing the structure of a caster according to one or more embodiments.

FIG. 13 is a view showing the structure of the caster according to one or more embodiments.

Referring to FIG. 13, the caster 60 according to the one or more embodiments may have a caster angle. The caster 60 may be provided at the bottom of the main body 10 such that the caster 60 rotates in all directions to possibly improve rotational mobility of the main body 10.

The caster 60 may include a caster frame 61, a caster wheel 62, a steering shaft 63, and a rotary shaft 64. The steering shaft 63 may be provided at the lower part of the main body 10. The caster frame 61 may be mounted at the bottom of the main body 10 to rotate about the steering shaft 63. The caster frame 61 may rotate about the steering shaft 63 according to movement of the main body 10 such that the caster frame 61 may be directed in all directions.

The rotary shaft 64 may be mounted to one side of the caster frame 61. The caster wheel 62 may be mounted to the rotary shaft 64 such that the caster wheel 62 may rotate about the rotary shaft 64. The caster wheel 62 may travel on a floor. That is, the caster frame 61 may rotate about the steering shaft 63 in all directions and the caster wheel 62 may rotate about the rotary shaft 64.

When the caster 60 is viewed from side, a straight line S1 interconnecting the rotary shaft 64 and a contact point between the caster wheel 62 and the floor may be spaced from a straight line S2 extending from the steering shaft 63 by a predetermined distance L2. When the straight line S1 interconnecting the center of rotation of the caster wheel 62 and the contact point between the caster wheel 62 and the floor is spaced from the straight line S2 extending from the steering shaft 63 by the predetermined distance L2 as described above, straight mobility of the caster 60 may be improved.

As the main body 10 rotates independently of the wheel assembly 50 and the wheels 52 move in the rotational direction of the main body 10 as described above, rotational movement of the main body may be performed. In addition, the main body 10 may be stably placed on the floor through the toe-in structure of the wheels and straight movement of the main body 10 may be performed. As straight movement and rotation of the main body 10 are easily performed, user convenience may be improved during use of the vacuum cleaner.

As is apparent from the above description, the vacuum cleaner according to one or more embodiments may be configured such that the center of gravity is located at the rear of each wheel. Consequently, straight movement of the vacuum cleaner may be performed. In addition, the main body may first rotate independently of the wheels during a change in direction of the vacuum cleaner and then the wheels may rotate in a direction in which the main body is directed. Consequently, the movement direction of the vacuum cleaner may be changed.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A vacuum cleaner comprising:

a main body comprising a fan motor to generate a suction force;

a suction unit connected to the main body to suction foreign matter from a surface to be cleaned using the suction force;

a dust collector separably mounted to the main body to separate and collect dust from air suctioned by the suction unit; and a wheel assembly to move the main body, wherein the wheel assembly comprises:

first and second frames provided at opposite sides of the main body, respectively, and a first wheel and a second wheel rotatably mounted to the first and second frames, the first and second wheels arranged such that a first centerline and a second centerline extend from a surface, respectively pass through respective centers of the first wheel and the second wheel, and meet each other above the main body.

2. The vacuum cleaner according to claim 1, wherein a front of each of the first and second wheels is directed inwardly of the main body and a rear of each of the first and second wheels is directed outwardly.

3. The vacuum cleaner according to claim 1, wherein a center of gravity of the main body is located behind a center of rotation of each of the first and second wheels.

4. The vacuum cleaner according to claim 1, wherein a distance between the first frame and the second frame at an lower part of the main body is greater than that at a upper part of the main body.

5. The vacuum cleaner according to claim 1, wherein the main body comprises at a bottom thereof a caster rotatable in all directions, and the caster comprises:

a steering shaft mounted at the bottom of the main body, a caster frame rotatable about the steering shaft in all directions, a rotary shaft mounted to the caster frame, and a caster wheel rotatable about the rotary shaft.

6. The vacuum cleaner according to claim 5, wherein the rotary shaft is spaced from a straight line extending from the steering shaft by a predetermined distance.

7. The vacuum cleaner according to claim 1, wherein the main body is rotatable independently of the wheel assembly such that when the main body has rotated to change a movement direction thereof, the main body is movable in the changed direction by the wheel assembly.

8. The vacuum cleaner according to claim 7, wherein a lower frame provided at a lower part of the main body, the lower frame comprising a first rotation guide in a protruding state.

9. The vacuum cleaner according to claim 8, wherein the main body comprises at a bottom thereof a receiving unit to receive the first rotation guide.

10. The vacuum cleaner according to claim 9, wherein the receiving unit comprises at an inside thereof a second rotation guide in a protruding state, the second rotation guide functioning as a rotary shaft of the main body.

11. The vacuum cleaner according to claim 8, wherein the lower frame comprises an elastic member.

12. The vacuum cleaner according to claim 11, wherein the main body comprises at a bottom thereof a pressing unit to press the elastic member, and the pressing unit presses the elastic member when the main body rotates to change the movement direction of the main body.

13. The vacuum cleaner according to claim 12, wherein the wheel assembly is rotated in a direction in which the main body is directed by elastic force of the elastic member.

14. The vacuum cleaner according to claim 11, wherein the lower frame comprises an elastic member mounting unit to receive the elastic member.

15. The vacuum cleaner according to claim 14, wherein the elastic member mounting unit is provided at a side thereof with a hole, through which the pressing unit presses the elastic member.

16. The vacuum cleaner according to claim 15, wherein an inside of the receiving unit interferes with the elastic member mounting unit or a stopper provided at the lower frame to restrict a rotational angle of the main body.

17. A vacuum cleaner comprising:

a main body; and a wheel assembly, to which the main body is rotatably mounted, to move the main body, wherein the wheel assembly comprises:

first and second frames provided at the opposite sides of the main body, respectively; and a first wheel and a second wheel rotatably mounted to the first and second frames, the first and second wheels arranged such that a first centerline and a second centerline extend from a surface, respectively pass through respective centers of the first wheel and the second wheel, and meet each other above the main body.

18. The vacuum cleaner according to claim 17, wherein the main body is rotatable independently of the wheel assembly such that when the main body has rotated to change a movement direction thereof, the main body is movable in the changed direction by the wheel assembly.

19. The vacuum cleaner according to claim 17, wherein a front of each of the first and second wheels is directed inwardly of the main body and a rear of each of the first and second wheels is directed outwardly.

20. The vacuum cleaner according to claim 17, wherein a center of gravity of the main body is located behind a center of rotation of each of the first and second wheels.

* * * * *